US005542135A

United States Patent [19]

Ozrovitz et al.

[11] Patent Number: 5,542,135

[45] Date of Patent: Aug. 6, 1996

[54] SELF-RETAINING BUMPER PAD

[75] Inventors: Aaron Ozrovitz, Southfield; Rosario Badalamenti, Sterling Heights, both of Mich.

[73] Assignee: Safe Surroundings, Inc., Southfield, Mich.

[21] Appl. No.: 441,065

[22] Filed: May 15, 1995

[51] Int. Cl.[6] ..... A47D 7/00

[52] U.S. Cl. ..... 5/424; 5/93.1; 5/663; 5/425

[58] Field of Search ..... 5/93.1, 424–427, 5/663

[56] References Cited

U.S. PATENT DOCUMENTS

| | | | |
|---|---|---|---|
| 4,672,698 | 6/1987 | Sands | 5/424 |
| 5,010,011 | 4/1991 | Mallett | 5/424 |
| 5,035,014 | 6/1991 | Blanchard | 5/424 |
| 5,044,025 | 9/1991 | Hunsinger et al. | 5/424 |
| 5,410,765 | 5/1995 | Dicken | 5/93.1 |

*Primary Examiner*—Michael Trettel

*Attorney, Agent, or Firm*—Gifford, Krass, Groh, Sprinkle, Patmore, Anderson & Citkowski, P.C.

[57] ABSTRACT

A self-retaining bumper pad for a bed is fabricated from elongated body of a soft, flexible material and includes a retention portion which fits between a side wall of the bed and an edge of the mattress and functions to hold the bumper pad in place. The pad further includes a shield portion which projects from the retention portion and overlies the side wall of the bed. The bumper pad cushions the side wall and also prevents a person who is in the bed from pushing an arm or a leg through the side wall of the bed.

10 Claims, 2 Drawing Sheets

SELF-RETAINING BUMPER PAD

FIELD OF THE INVENTION

This invention relates generally to bedding. More specifically, the invention relates to a bumper pad for BEDS. Most specifically, the invention relates to a bumper pad which is configured to engage, and be retained between, the mattress and rail or other side wall of the bed.

BACKGROUND OF THE INVENTION

Cribs and other infant beds; of the type which include side walls for retaining the infant therein, are frequently equipped with bumper pads. These pads are usually an after-market item and typically comprise a cushioned body tied, or otherwise affixed to the side wall of the bed. The bumper pad cushions the side wall preventing harm to the baby. The design of prior art bumper pads has generally been found to be unsatisfactory, particularly for older and more active babies. The prior art bumper pads are typically affixed by tying to the rails of the crib, and as the baby moves about it can push the bumper pad causing is to ride up the rail thereby exposing side wall of the crib. Furthermore, it has been found that a number of accidents have resulted when a baby pushes its arm or leg beneath the bumper pad and through the crib rails. Bumper pads of various types are also used in combination with more conventional beds of the type used for youths, as well as with adult beds, as for example in hospitals, nursing homes or private residences. Problems similar to those described above are encounter with such pads.

Various attempts have been made in the prior art to provide bumper pads for beds which are not prone to ride up the side rails and which prevent an infant or adult from pushing its arms or legs beneath the pad and through the rails. U.S. Pat. No. 3,877,090 discloses a crib bumper pad which includes a set of snap fasteners which engage corresponding fasteners mounted on the crib mattress so as to retain the bumper pad. This assembly requires a modification to the crib mattress which interferes with the placement of a sheet on the mattress; furthermore, this design does not eliminate the possibility of an infant pushing its foot or arm beneath the pad. U.S. Pat. No. 3,321,799 discloses a crib mattress having bumper pads integral therewith. While this design prevents an infant from pushing its arms or legs beneath the pad, it necessitates the purchase of a special mattress, and the presence of the permanently attached bumper pads complicates the making of the bed. U.S. Pat. No. 3,619,824 discloses a crib bumper pad which includes a number of separate bumper units attached to a large cloth sheet. The sheet is passed beneath the mattress, and the bumper units are folded up and supported on an upper edge of the bed. While this design eliminates the problem of the pad riding up, and prevents a child from pushing an arm or a leg through the bed, use of this bumper pad is difficult, because the mattress must be removed for placement of the pad.

Therefore, it will be appreciated that there is a need for a bumper pad which can be affixed to a crib or other bed and which is not easily displaced and which functions to prevent a sleeper from pushing an arm or a leg through the bed. The pad should be easy to use and not require modification of the bed. As will be described in greater detail hereinbelow, the present invention provides a self-contained, easy to use, low cost bumper pad which achieves these goals. These and other advantages of the present invention will be readily apparent from the drawings, discussion and description which follow.

BRIEF DESCRIPTION OF THE INVENTION

There is disclosed herein self-retaining bumper pad for a bed. The pad is fabricated from an elongated body of a soft, flexible material which has a length dimension greater than a width dimension. The body includes a retention portion which is configured to fit between a side wall of the bed and an edge of the mattress, as well as a shield portion which extends transversely from the retention portion. The shield portion is disposed so as to overlie a portion of the side wall above the mattress when the retention portion is disposed between the mattress and the side wall. In a particular embodiment, the retention portion includes a notch configured to engage the mattress, and the notch may further include a bottom lip to enhance retention of the pad. The pad may be made from a resilient, polymeric foam and may also be made flame retardant and/or hypo-allergenic. In some embodiments, the bumper pad includes a cover. The pad may further include ties, straps or the like for further fastening it onto the bed railing.

DETAILED DESCRIPTION OF THE INVENTION

It is to be understood that the present invention may be used with a variety of beds and the like including cribs, bassinets, play pens, hospital beds, youth beds and conventional beds. One specific embodiment of the invention will be described with reference to an infant's crib.

Figure 1:
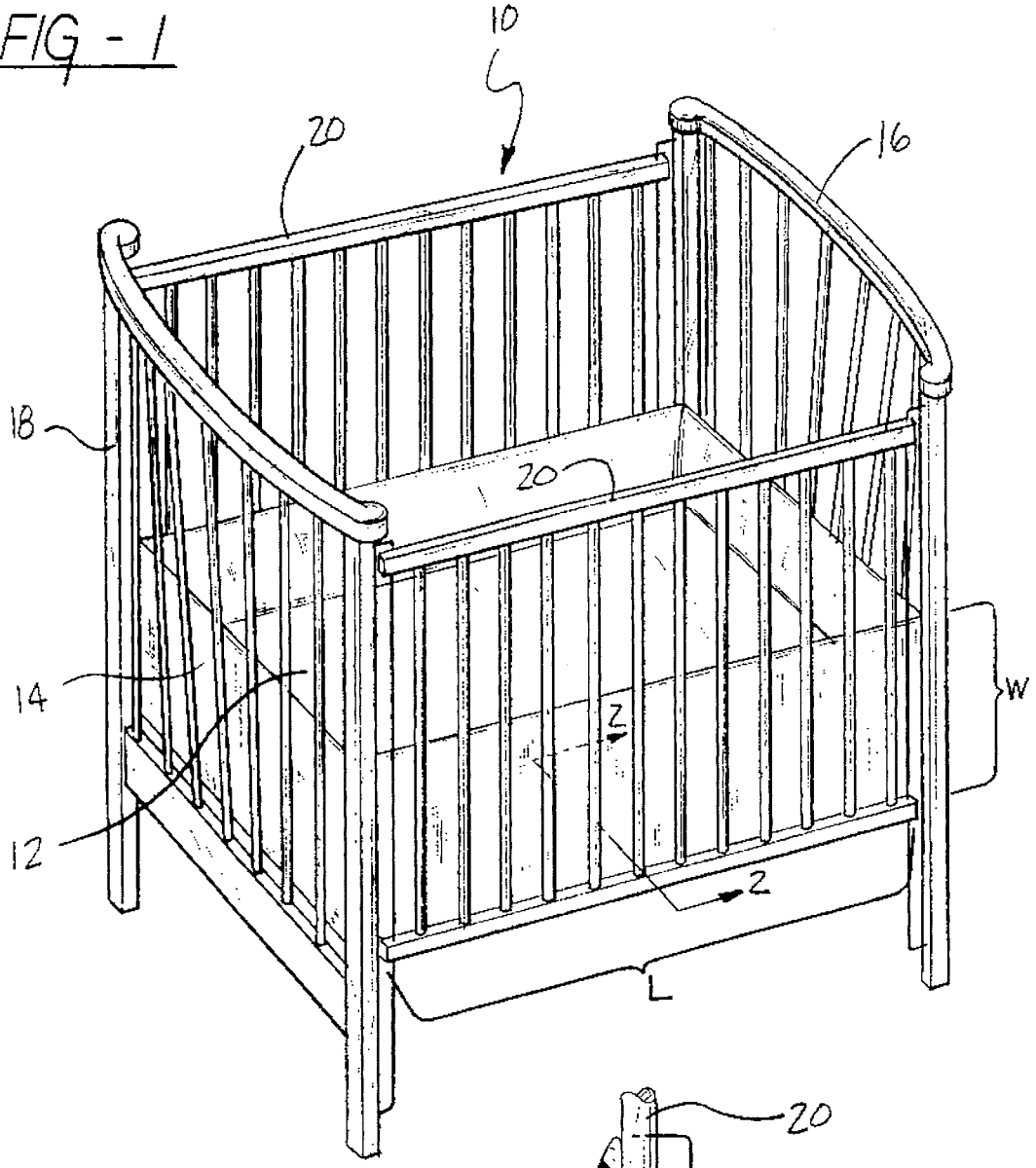
FIG. 1 is a perspective view of a child's crib showing the bumper pad of the present invention disposed therein.

Referring now to FIG. 1, there is shown a perspective of a child's crib 10 having a mattress 12 therein, and further including a bumper pad 14 of the present invention. As illustrated, the bumper pad 14 includes a plurality of sections, each having a width W and a length L. The sections are joined at corners of the crib 10 so as to surround a portion of the interior side walls of the crib. Within the context of this disclosure, the side walls of the crib are defined as including the head board 16, foot board 18, and side rails 20 of the crib 10; whether they are of an open, slatted structure as shown, or if they are solid members.

Figure 2:
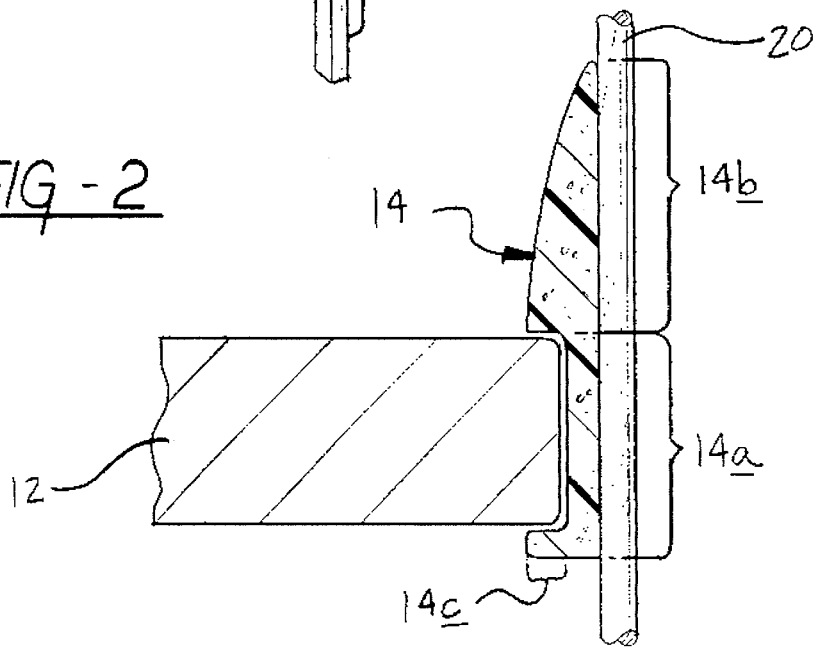
FIG. 2 is a cross sectional view of one embodiment of pad structured in accord with the principles of the present invention as disposed in a crib.

Referring now to FIG. 2, there is shown a cross sectional view of a pad 14, generally similar to that shown in FIG. 1. The pad 14 of FIG. 2 is disposed so as to be retained by a mattress 12 and side wall, for example rail 20 of the bed of FIG. 1, so as to shield a portion of the side wall 20.

As illustrated in FIG. 2, the bumper pad 14 includes a retention portion **14*a* which is configured to fit between an edge of the mattress 12, and a portion of the side wall 20. The retention portion 14*a*, in the illustrated embodiment, includes a notch defined therein which is configured to engage the edge of the mattress 12. The retention portion 14***a* further includes a projecting bottom lip portion 14*c*, which wraps around the bottom of the mattress 12 and further prevents displacement of the pad 14.

The pad 14 of FIG. 2 includes a shield portion 14*b* which extends transversely from the retention portion 14*a*; by transverse extension is meant that the shield portion 14*b* extends laterally away from the retention portion 14*a*, in the width dimension W, and transverse to the length dimension L. As illustrated, the retention portion 14*a* and shield portion 14*b* are generally co-planar. When the bumper pad is in use, the shield portion 14*b* extends above the mattress 12 so as to overlie a portion of the side wall 20 above the mattress. In this manner, the shield portion 14*b* protects the infant from contact with the side wall 20. Furthermore, the fact that the retention portion 14*a* is disposed between the mattress and side wall precludes a child from pushing an arm or a leg beneath the pad and through the side of the crib. The width "W" of the pad will depend upon the thickness of the mattress, and the portion of the sidewall above the mattress which is to be protected in general, the pad will be in the range of 10–30 inches wide.

The pad of the present invention is fabricated from a body of soft, flexible material. Most preferably, the material has sufficient resiliency so as to permit the retention portion thereof to be compressed by, and expand against the mattress and side wall. Among some of the preferred materials are foamed polymers such as urethane foam, polyethylene foam, foam rubber and the like. One preferred material includes a self-skinning polymeric foam such as a urethane foam. Foams of this type may be cast into a variety of configurations, and comprise an interior having a flexible, cellular structure, and an exterior skin comprised of a smooth, flexible, impervious surface.

Figure 3:
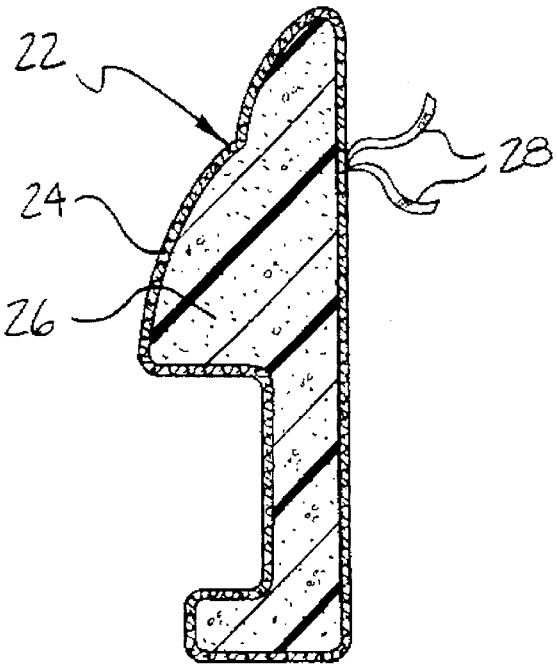
FIGS. 3–5 are cross sectional views of other embodiments of bumper pads structured in accord with the principles of the present invention.

Referring now to FIG. 3, there is shown yet another embodiment of bumper pad 22 structured in accord with the present invention. The pad 22 of FIG. 3 includes a cover 24 thereupon enclosing an interior core 26. The cover 24 can be comprised of a flexible sheet material, such as cloth, synthetic polymeric material and composites thereof. The cover 24 may be made replaceable so as to permit cleaning thereof. In some instances, the cover 24 may be provided with design indicia thereupon so as to harmonize with room decor, bedding or the like. The core 26 may be fabricated from a polymeric foam material as previously described, or it may comprise body of fiber fill, upholstery stuffing, granular polymeric foam or the like which is retained by the cover 24. It will further be noted that the pad 24 of FIG. 3 further includes a fastener 28 thereupon. While the pad of the present invention is self-retaining, in some instances, it may be desirable to include another fastener to firmly affix the top shield portion of the pad to a bed rail or the like. In the illustrated embodiment, the fastener 28 comprises a pair of tapes which may be tied to the bed rail. It is to be understood that snaps, hooks and loop fastener material and other such fasteners may be similarly employed. Also, the fastener 28 may be placed at the top of the pad 24, or at any other convenient location thereupon.

Figure 4:
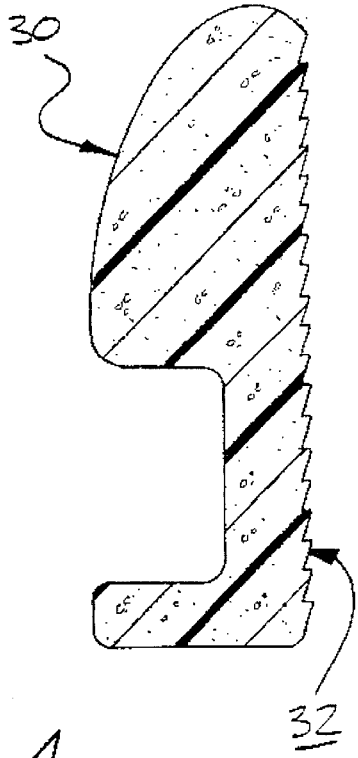

Referring now to FIG. 4 there is shown another embodiment of bumper pad 30 structured in accord with the present invention. The pad 30 of FIG. 4 is generally similar to that of FIG. 14 except that it includes a textured surface 32 on the portion thereof which contacts the side wall of the bed. This textured surface 32 helps to further retain the bumper pad 30 against the bed railings.

Figure 5:
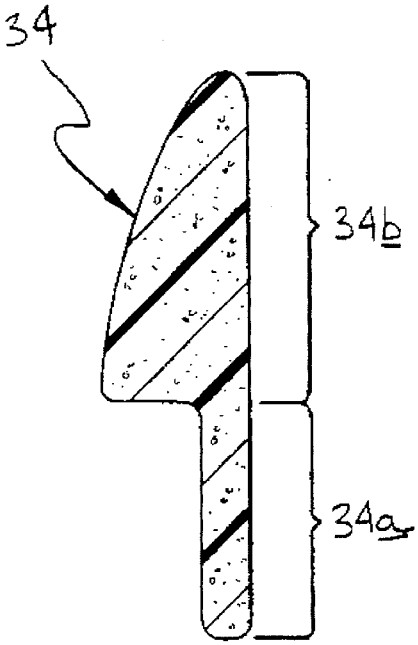

FIG. 5 depicts yet another embodiment of bumper pad 34 structured in accord with the present invention. The pad 34 of FIG. 5 is also generally similar to that of FIG. 2, except that the retention portion 34*a* thereof does not include a bottom lip.

Figure 6:
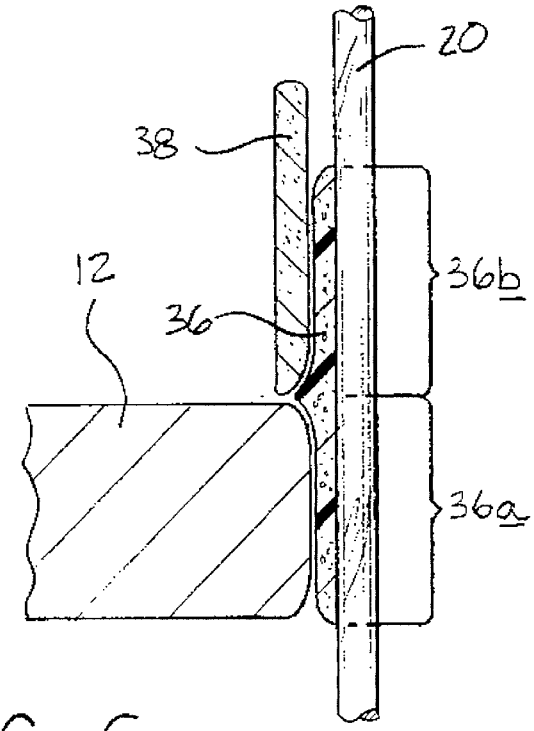
FIG. 6 is a cross sectional view of yet another embodiment of bumper pad structured in accord with the principles of the present invention, and shown as deployed in a crib.

Referring now to FIG. 6, there is shown yet another embodiment of bumper pad 36 structured in accord with the principles of the present invention. The bumper pad 36 is configured to be utilized in connection with a preexisting bumper pad 38, which is of the type known in the prior art, and does not include any section which projects into the space between the edge of the mattress 12 and side wall 20 of a bed as does the bumper pad of the present invention. The pad 36 of the FIG. 6 embodiment includes a retention portion 36*a*, which fits between the side wall 20 and mattress 12, and further includes a shield portion 36*b* as previously described. In the pictured embodiment, the retention portion 36*a* includes a notch which engages the mattress 12, and the shield portion 36*b* also includes a notch which allows for the presence of the preexisting bumper pad 38. As in the foregoing embodiments, a bottom lip may be included.

A number of sections, typically four, may be joined together to form a unit configured to fit a particular bed. The sections may be separate members which are joined together at the corners of the bed. For example, the members may be encased in a cover generally similar to the FIG. 3 embodiment, and the cover may function to hingedly join the members. Alternatively, a single f long member may be folded at the corners to provide wrap around protection for a bed. Folding may be facilitated by notching the members at the corners; for example, by forming a groove therein running in the width dimension and parting through the thickness of the member. While the invention has been primarily described with reference to cribs, it may likewise be adapted to play pens, car beds, cradles, bassinets, adult beds and the like, all of which are collectively referred to herein as beds.

Other modifications and variations of the present invention may be implemented by one of skill in the art. Accordingly, it is to be understood that the foregoing drawings, discussion and description are merely meant to illustrate particular embodiments of the present invention, and are not meant to be limitations upon the practice thereof. It is the following claims, including all equivalents, which define the scope of the invention.

We claim:

1. A self-retaining bumper pad for a bed, said pad comprising:

an elongated body of a soft, flexible material having a length dimension which is greater than a width dimension thereof; said body comprising:

a retention portion configured to fit between a side wall of a bed and an edge of a mattress disposed in said bed, said retention portion including a notch which extends along the length thereof and is configured to engage an edge of the mattress, and a bottom lip which is coextensive with at least a portion of the length of the notch; and a shield portion which extends transversely from said retention portion, said shield portion being disposed so as to overlie a portion of said side wall above said mattress, when the retention portion is disposed between said mattress and side wall.

2. A bumper pad as in claim 1, wherein said body of soft, flexible material comprises a body of polymeric foam.

3. A bumper pad as in claim 2, wherein said foam is a flame retardant foam.

4. A bumper pad as in claim 2, wherein said foam is a hypo-allergenic foam.

5. A bumper pad as in claim 1, wherein said body of soft, flexible material includes a cover fabricated from a sheet material.

6. A bumper pad as in claim 1, further including a fastener disposed upon said shield portion, said fastener operative to affix said shield portion to said side wall.

7. A bumper pad as in claim 1, wherein the width of said body of soft, flexible material is in the range of approximately 10–30 inches.

8. A bumper pad as in claim 1, wherein said bed is a crib.

9. A bumper pad as in claim 1 wherein said bed is a member selected from the group consisting of: cribs, bassinets, play pens, car beds, youth beds, hospital beds and adult beds.

10. A self-retaining bumper pad for a child's crib, said pad comprising:

an elongated body of a soft, flexible material having a length dimension which is greater than a width dimension thereof; said body comprising:

a retention portion extending along the entirety of the length of, and along only a portion of the width of said elongated body, said retention portion being configured to fit between a side wall of a crib and an edge of a mattress disposed in said crib, said retention portion including a notch defined along the length thereof, said notch being configured to engage the edge of said mattress, said retention portion further including a bottom lip coextensive with at least a portion of the length of said notch; and a shield portion which is generally coextensive with the length of said body and which extends transversely from the retention portion, said shield portion being disposed so as to overlie a portion of said side wall above said mattress when the retention portion is disposed between the mattress and the side wall.

* * * * *